US007354497B2

(12) United States Patent
Ceulemans

(10) Patent No.: US 7,354,497 B2
(45) Date of Patent: Apr. 8, 2008

(54) METHOD FOR MANUFACTURING CORRUGATED BOARD USING MAGNETS TO BOND

(75) Inventor: Olivier Michel Monique Ceulemans, Gierle (BE)

(73) Assignee: Corrutech, Naamloze Vennootschap, Turnhout (BE)

( * ) Notice: Subject to any disclaimer, the term of this patent is extended or adjusted under 35 U.S.C. 154(b) by 333 days.

(21) Appl. No.: 10/763,245

(22) Filed: Jan. 26, 2004

(65) Prior Publication Data

US 2004/0149374 A1 Aug. 5, 2004

(30) Foreign Application Priority Data

Jan. 27, 2003 (BE) ..... 2003/0056

(51) Int. Cl.
*B31F 1/20* (2006.01)
*B30B 1/42* (2006.01)

(52) U.S. Cl. ..... 156/205; 156/196; 156/580

(58) Field of Classification Search ..... None
See application file for complete search history.

(56) References Cited

U.S. PATENT DOCUMENTS

| | | | | |
|---|---|---|---|---|
| 4,541,889 | A * | 9/1985 | Held | 156/583.5 |
| 4,764,236 | A | 8/1988 | Nikkel | |
| 4,948,467 | A * | 8/1990 | Creagan | 162/358.3 |
| 5,129,980 | A | 7/1992 | Sissons | |
| 5,303,440 | A * | 4/1994 | Zimmer | 8/151 |
| 6,257,296 | B1 * | 7/2001 | Pallas et al. | 156/470 |

FOREIGN PATENT DOCUMENTS

| | | |
|---|---|---|
| EP | 0 825 017 A1 | 2/1998 |
| EP | 0 890 429 A1 | 1/1999 |

* cited by examiner

*Primary Examiner*—Richard Crispino
*Assistant Examiner*—Barbara J. Musser
(74) *Attorney, Agent, or Firm*—Bacon & Thomas, PLLC

(57) ABSTRACT

Method for manufacturing corrugated board or the like, whereby different material strips (3-6) are fastened together by means of a bonding agent, whereby one or several material strips (3-6) are guided along at least one press-on device (15-16), where they are guided over one or several elements (10-14), in particular supporting elements, and are pressed against them by means of a series of movable press-on parts (19), wherein for pressing on these press-on parts (19), use is made of magnetic forces.

6 Claims, 4 Drawing Sheets

METHOD FOR MANUFACTURING CORRUGATED BOARD USING MAGNETS TO BOND

BACKGROUND OF THE INVENTION

1. Field of the Invention

The present invention concerns a method and a device for manufacturing corrugated board or the like.

2. Discussion of the Related Art

It is known that the production of corrugated board takes place in different steps. Single corrugated board, which normally consists of a corrugated intermediate layer which is glued between two outer layers, is produced for example by providing a waveform to the material for the intermediate layer in a first step and by subsequently gluing the material for the outer layers on both sides of it. The material for forming the above-mentioned layers is hereby continuously supplied in the shape of material strips. First, a first outer layer is glued onto one side of the corrugated intermediate layer, and then the second outer layer onto the other side. As material strips with glue in between are joined together, the material strips have to be pressed well together in order to obtain a good bond. To this end, the material strips are guided along different parts of a device to provide the glue on the one hand and to compress the material strips on the other hand.

When the first outer layer is fastened to the corrugated intermediate layer, this intermediate layer can still be supported at its free side, for example by means of a supporting roller with a corrugated surface. Afterwards, an outer layer will also have to be provided on the other side of the intermediate layer. However, this is not as simple as in the first step, since the corrugation of the intermediate layer can no longer be supported now, so that any pressing on will have to be done with some care in order to prevent the corrugated intermediate layer and any possible outer layers from being flattened and/or damaged.

When producing corrugated board, it is also important to make sure that, on the free side of the corrugated board covered on one side, all the wave tops are entirely covered with glue, such that the second outer layer can be fastened well.

A device is known from U.S. Pat. No. 5,129,980 whereby use is made of press-on shoes to press the corrugated board covered on one side against a glue roll. The press-on shoes are hereby fixed to a frame in a pivoting manner, and a spring is situated between every press-on shoe and the frame, such that the corrugated board covered on one side is pressed against the glue roll.

Further, every press-on shoe is provided with an adjusting screw which is to guarantee a minimum distance between the glue roll and the press-on shoe concerned when cardboard is no longer available, in order to avoid that, when the cardboard comes out, the press-on shoe would make contact with the glue roll, as a result of which glue would end up on the press-on shoe and the glue roll could be damaged.

A disadvantage of this known embodiment consists in that the above-mentioned springs, as they are movable and deformable elements, may jam, or in other words get locked. Also, frictional forces may be created between said spring and the guide around which this spring is usually provided.

Moreover, such friction causes wear, as a result of which cracks and the like may occur. Due to said wear, as well as due to the vibrations which are generated in such a spring, it will also be subject to ageing. Because of the aforesaid friction, which is often variable, and as a result of the above-mentioned other factors, it is often difficult to ensure a permanent press-on force, which often has a negative effect on the quality of the produced end product. For an irregular pressing-on may result in an irregular gluing and a bad bonding, as well as to unwanted impression marks in the cardboard.

Further., the use of springs requires a regular maintenance.

SUMMARY OF THE INVENTION

The present invention in general aims a method and a device for manufacturing corrugated board or the like, whereby an improved method for the pressing on is provided in one or several process stages in which a material strip or material strips are being pressed on, such that when manufacturing the corrugated board, it is possible to guarantee a stable end product. To this end, a press-on method is concerned which can be applied at different locations in the production process of the corrugated board, for example as a material strip is being pressed on to a glue roll or the like, or for example during the pressing-on for joining two material strips together with the inclusion of a bonding agent.

In particular, the present invention also concerns a technique whereby the above-mentioned disadvantages of the known embodiments are excluded.

To this end, the invention in the first place concerns a method for manufacturing corrugated board or the like, whereby different material strips are fastened together by means of a bonding agent, whereby the material strips are guided through at least one press-on device, in which they are guided over one or several elements, in particular supporting elements, and are pressed against them by means of a series of movable press-on parts, in particular press-on shoes, characterized in that for pressing on these press-on parts, use is made of magnetic forces.

More in particular, use is preferably made of only magnetic forces for the pressing on, possibly increased or decreased with a force resulting from the used parts' own weight. However, this does not exclude that, according to a variant, use can also be made of the combination of a magnetic force with a force which is obtained by other press-on means than magnets for the pressing on, for example the combination of a magnetic force with a spring force.

By making use of a magnetic press-on force, all the disadvantages related to the use of pressure springs are excluded, at least when the use of such pressure springs is thereby entirely renounced. Also in the case of the combination of a magnetic press-on force with a spring force, the invention is still advantageous, because the springs used thereby will be loaded less in this case, and the above-mentioned disadvantages of the use of springs will be less apparent.

According to the most preferred embodiments, the above-mentioned magnetic forces, and thus the resulting press-on, are realized by means of one or several permanent magnets. An advantage of the use of permanent magnets consists in that the construction is very simple and requires practically no maintenance.

According to a special embodiment, use is moreover made of adjusting means with which the above-mentioned magnetic force which is being exerted on the press-on parts, and thus also the press-on force exerted by the press-on parts on the underlying material strip, can be adjusted and/or set.

It should be noted that the use of press-on parts, whose press-on force can be adjusted, is also advantageous in combination with press-on means whereby the press-on force is generated in another manner than by means of a magnetic force. According to a second aspect of the invention, it also concerns a method for manufacturing corrugated board or the like, whereby different material strips are fastened together by means of a bonding agent, whereby the material strips are guided through at least one press-on device, in which they are guided over one or several elements, in particular supporting elements, and are pressed against them by means of a series of moveable press-on means, characterized in that for pressing on these press-on means, use is made of pressure means which are adjustable, with which the press-on force exerted by the press-on parts can be adjusted and/or set, irrespective of the nature of the pressure means, in other words irrespective of whether the pressure means consist of magnets, elastic means such as springs or other forms of pressure means. In particular, pressure means are hereby concerned which make it possible to adjust and/or set the exerted force in a continuously variable or practically continuously variable manner, such that a fine adjustment becomes possible. Moreover, according to the invention, the press-on forces can preferably be individually adjusted and/or set for at least a number of press-on parts, and better still for all the press-on parts.

The use of press-on forces which can be adjusted and/or set offers several advantages, a number of which will be explained hereafter.

From practice, it is known that the outer press-on parts or press-on shoes are subject to more wear than the press-on parts which are situated more centrally. By making use of pressure means whose exerted force is adjustable, the pressure force exerted by the outer press-on parts, which decreases due to wear, can now be adjusted according to the invention, such that it remains almost permanent. The adjusting possibility also offers the advantage that different pressure forces can be exerted at the different press-on parts, which may be useful when manufacturing special embodiments of corrugated board.

The adjustment and/or setting of the above-mentioned press-on force can take place in any way whatsoever according to the invention, as a function of the required possibilities. It can be done manually, for example by means of adjusting screws or the like, as well as in a more or less automated manner. In the later case, use can be made of remote-controlled drive means.

Apart from that, the invention also concerns a device for realizing the above-mentioned method, namely a device for manufacturing corrugated board or the like, of the type whereby different material strips are fastened together by means of a bonding agent, whereby the material strips are guided over one or several elements, in particular supporting elements, and are pressed against them by means of a series of moveable press-on parts, upon which a force is exerted by means of pressure means, characterized in that at least a number of these pressure means are at least partially formed of magnetically co-operating parts.

In conformity with the aforesaid second aspect of the invention, it also concerns a device for manufacturing corrugated board or the like, of the type whereby different material strips are fastened together by means of a bonding agent, whereby the material strips are guided over one or several elements, in particular supporting elements, and are pressed against them by means of a series of moveable press-on parts, upon which is exerted a force by means of pressure means, characterized in that it comprises adjusting means with which, at least at a number of the aforesaid press-on parts, the force exerted by the pressure means can be adjusted and/or set.

Further characteristics will become clear from the following description and the accompanying claims.

It is clear that the invention also concerns components which are specifically designed to form the above-mentioned device, such as press-on parts, in particular press-on shoes which are provided with magnets, parts which make it possible to realize an adjustment as mentioned above, etc.

BRIEF DESCRIPTION OF THE DRAWINGS

In order to better explain the characteristics of the invention, the following preferred embodiments are described as an example only without being limitative in any way, with reference to the accompanying drawings, in which.

DESCRIPTION OF THE PREFERRED EMBODIMENT

Figure 1:
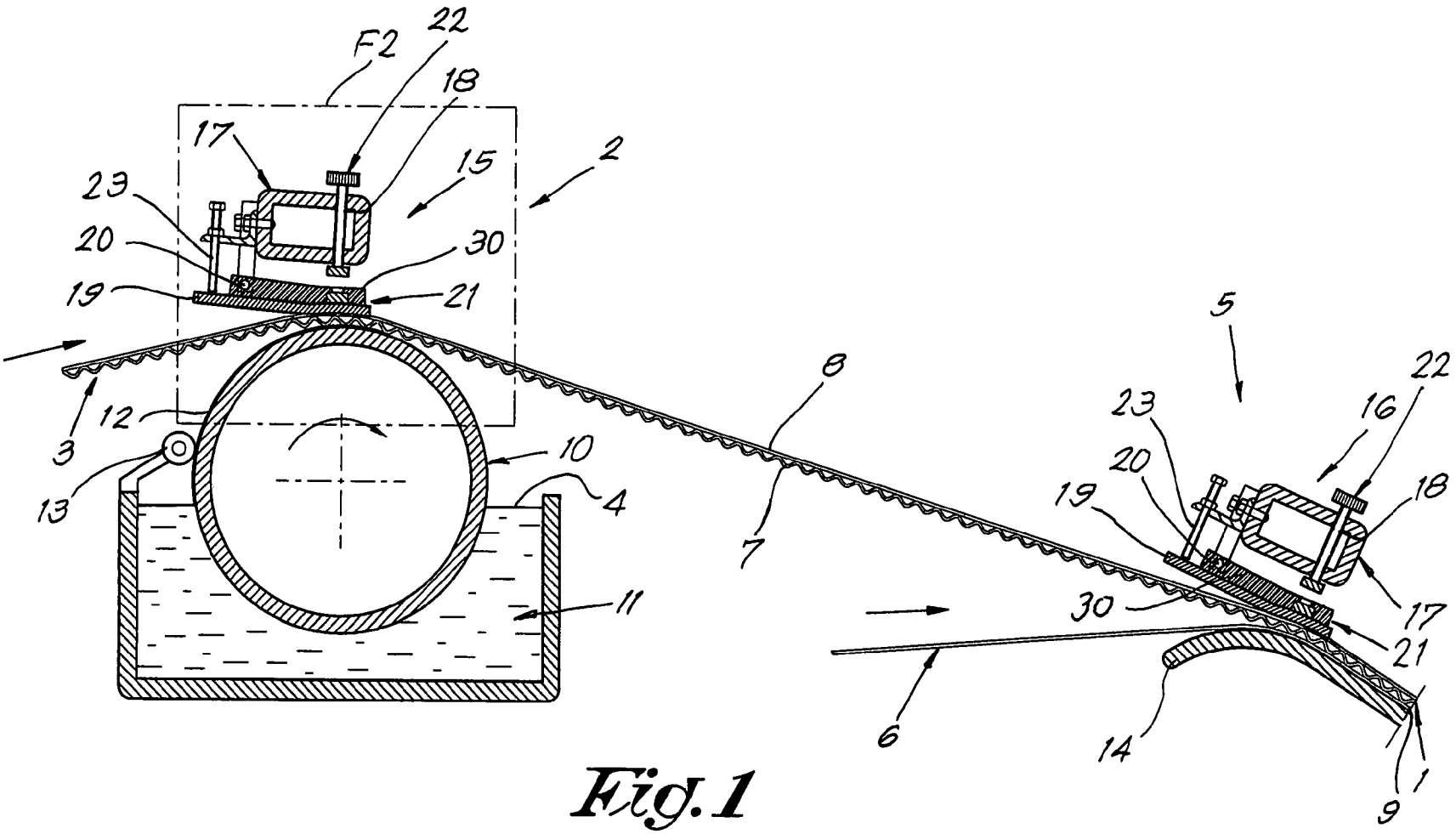
FIG. 1 represents a part of a device according to the invention.

FIG. 1 represents a section of a part of a device for manufacturing corrugated board 1 or the like. This part specifically represents a station 2 in which is provided a material strip 3 of a bonding agent, in particular glue 4, and a station 5 in which the material strip 3 provided with glue 4 is joined together with a material strip 6 in order to fasten the material strips 3 and 6 together.

In the given example, the material strip 3 consists of an intermediate layer 7 and an outer layer 8 which have been previously fastened together, whereas the material strip 6 as such is designed to form a second outer layer 9 of the corrugated board 1.

In the station 2, the material strip 3 is guided over an element 10, in particular a supporting element, which functions as a glue applicator, in particular a glue roll. This glue roll rotates through a glue bath 11, such that a film 12 of glue 4 is carried along by the glue roll. Excess glue is removed by means of an element 13 such as a counter-roller or a scraper.

In station 5, the material strips 3 and 6 are guided over an element 14, where they are joined together.

In every station 2, 5 respectively, is provided a press-on device 15, 16 respectively, which in this case have a similar construction.

Figure 2:
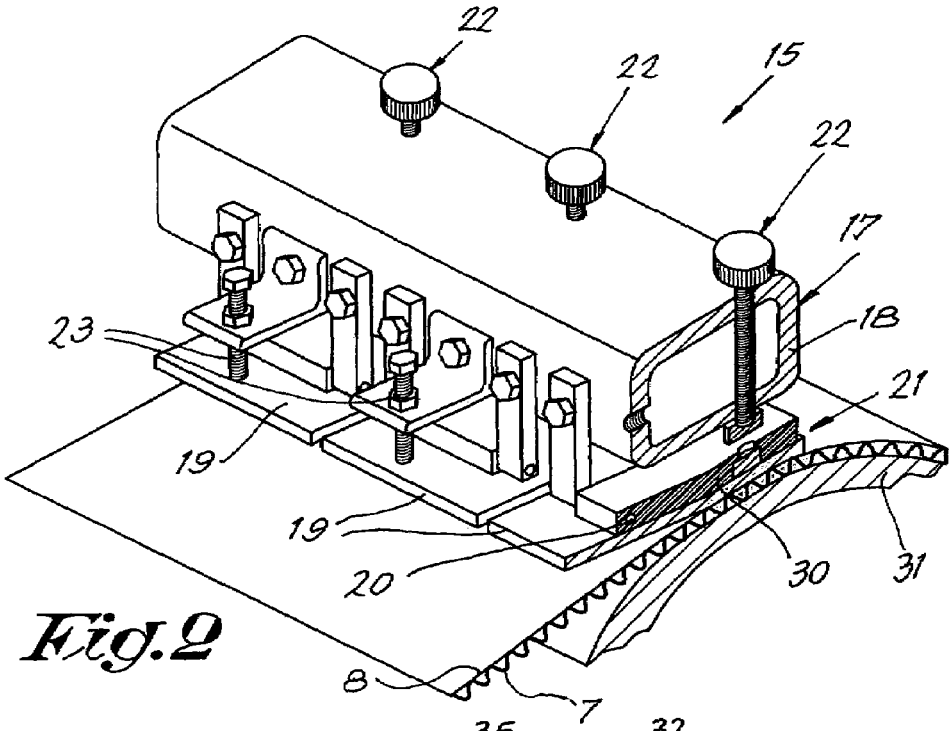
FIGS. 2 and 3 represent the part indicated with F2 in FIG. 1 in perspective and to a larger scale.
Figure 3:
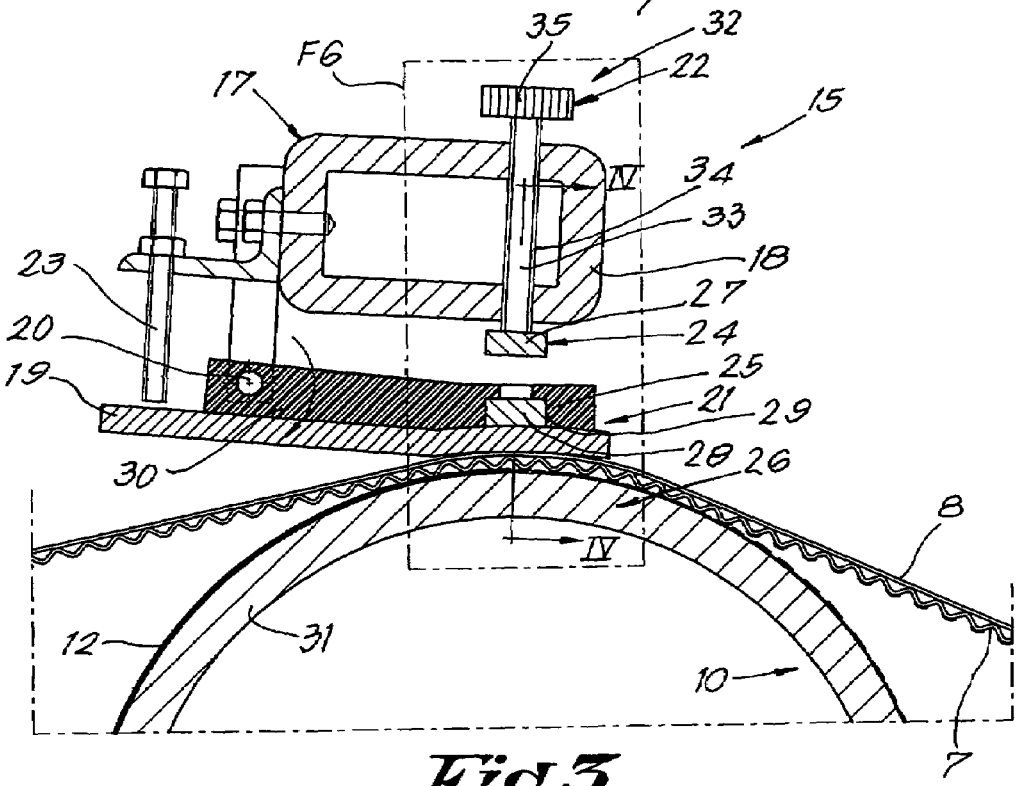

The press-on device 15 comprises, as represented in FIGS. 1 to 3, a frame 17 which is mainly formed of a cross beam 18 which extends parallel to the element 10, i.e. the glue roll. On this cross beam 18 is mounted a series of movable press-on parts 19 in the shape of press-on shoes situated next to each other.

In the given example, the press-on parts 19 are movable as they are fixed in a rotating manner to the frame 17 along rotary shafts 20. The press-on parts 19 are hereby situated with their front ends 21 at the height of the surface of the glue roll.

Further, the press-on device 15 comprises pressure means 22 which make sure that the press-on parts 19 are pressed against the material strip 3 concerned.

As represented, the whole is further also provided with stop elements 23 forming an end position for the press-on parts 19, which in this case consist of adjusting screws, such that, should the supply of the material strip 3 be interrupted, the press-on parts 19 cannot possibly make contact with the aforesaid glue roll.

A first special aspect of the present invention consists in that the above-mentioned pressure means 22 are at least formed of magnetically co-operating parts, in this case, as is specifically indicated in FIG. 3, three parts, 24, 25 and 26 respectively, whereby the parts 24 and 25 are situated on one side of the material strip 3, whereas the parts 25 and 26 are mutually situated on either side of the material strip 3 respectively.

Figure 4:
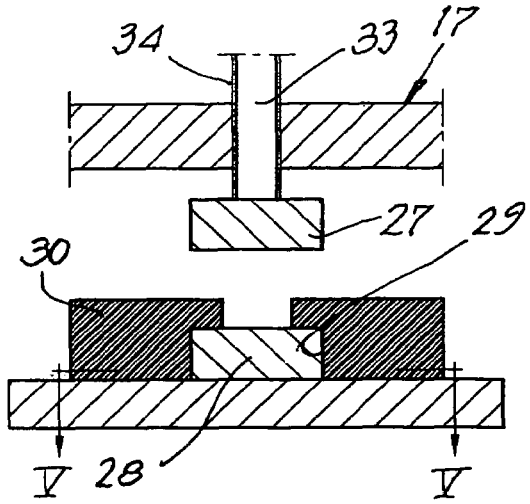
FIG. 4 represents a section according to line IV-IV in FIG. 3.
Figure 5:
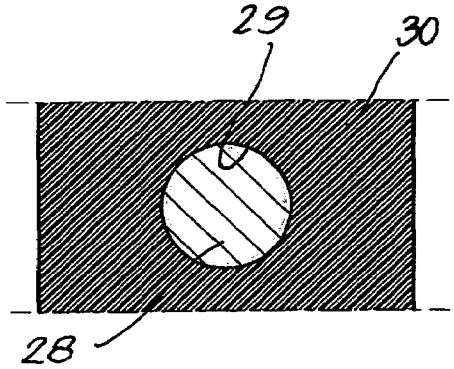
FIG. 5 represents a section according to line V-V in FIG. 4.

The parts 24 and 25 mainly consist of permanent magnets 27 and 28 situated opposite to each other and repelling each other, which are provided to the frame 17 and to the press-on parts 19 respectively. The magnets 28 are situated on top of the press-on parts 19 and they are fixed because they are provided in a recess 29 formed in an accompanying holder 30, made of plastic for example, as represented in detail in FIGS. 3 to 5, and which is connected to the press-on part 19 concerned in a fixed manner.

The above-mentioned part 26 is formed of the casing 31 of the glue roll, which to this aim consists of a magnetically attractable material, in particular metal, so that not only a repellent force is generated between the magnets 27 and 28, but also an attractive force between the magnet 28 and the casing 31.

A second special aspect of the present invention consists in that the attractive device 15 is provided with adjusting means 32 with which the above-mentioned magnetic force, and thus also the press-on force, exerted by the press-on parts 19, can be adjusted and/or set. In the embodiment of FIGS. 1 to 5, these adjusting means 32 consist of adjusting screws 33 with which the position of every magnet 24 can be changed, such that the size of the repellent force in relation to every magnet 25 concerned can be changed, and thus also the force can be set with which the press-on parts 19 are pressed onto the material strip 3. The adjusting screws 33 are provided with screw thread 34 with which they can be rotated in the cross beam 18. The magnets 24 are each time fixed against the lower end of the adjusting screw 33 concerned, for example welded onto it.

The adjusting screws 33 can be rotated by means of a turning button 35.

The press-on device 16 is built in an analogous manner, but it co-operates with the element 14 in this case which is made as a fixed, bent support instead of with an element 10 in the shape of a roll.

The working of the device, and in particular of the press-on devices 15 and 16, as well as the resulting method, can be easily derived from the figures, but they will be also briefly explained hereafter.

The material strips 3 and 6, as indicated by the arrows in FIG. 1, are drawn through the stations 2 and 5, which can be realized in any way whatsoever. Since this is known as such, it will not be further explained.

Glue 4 is provided against the bottom side of the material strip 3 by the element 10. By means of the press-on parts 19 in the station 2, the material strip 3 is pressed against the element 10 with a regular pressure, such that the glue 4 is transferred to the downward directed tops of the corrugated intermediate layer 9. Thanks to the invention can be guaranteed an optimal press-on, excluding the disadvantages of the use of springs, in particular of non-adjustable springs.

By means of the adjusting means 32, the press-on force can be set at a desired value in order to provide for a further optimization. The setting can hereby be done as a function of different parameters and factors, such as for example the thickness of the material strip 3, the nature of the material out of which said material strip 3 is composed, etc.

In station 16, the material strip 6 is glued against the material strip 3, whereby a press-on is provided for in an analogous manner with the same advantages as in station 15.

Although, in FIGS. 1 to 5, an embodiment is represented whereby the position of the magnet 27 can be set, it is clear that, according to the invention, also a magnetic press-on can be provided for without any adjusting means 32 being required. Even then, the advantages of the use of a magnetic press-on and/or attraction still remain.

Figure 6:
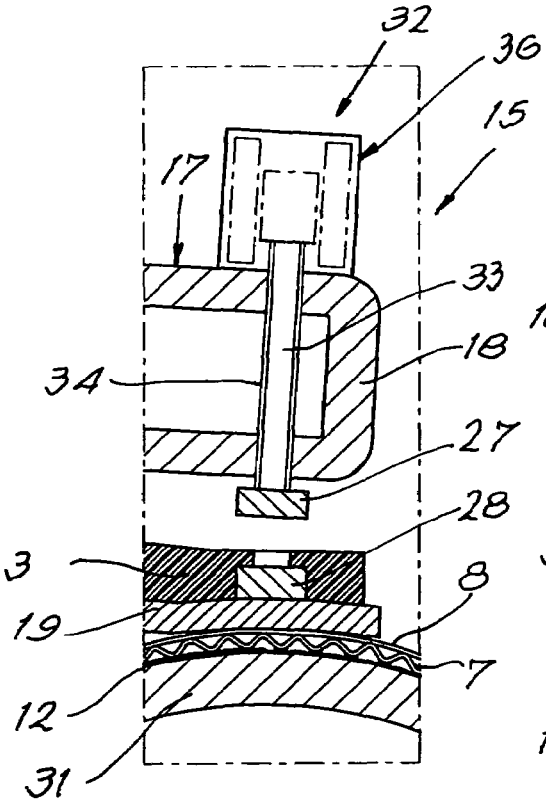
FIGS. 6 and 7 represent two variants of the part indicated with F6 in FIG. 3.
Figure 7:
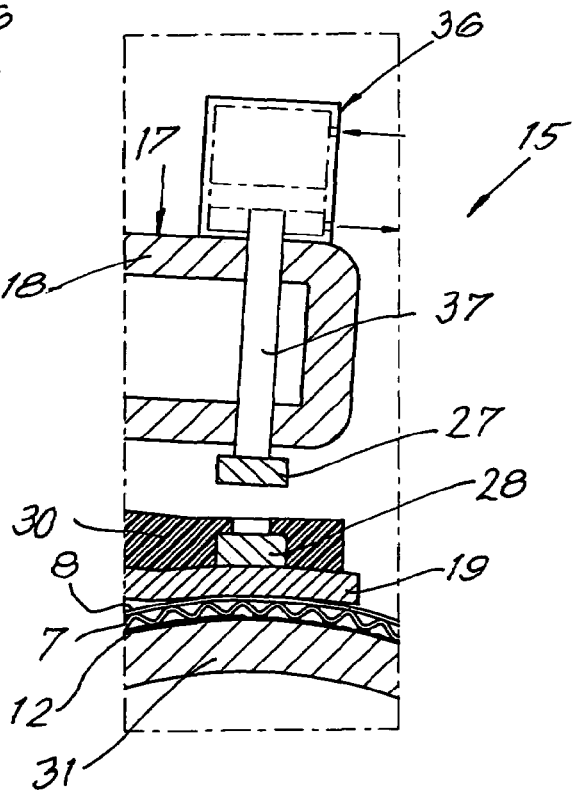

FIGS. 6 and 7 represent two variants whereby the adjusting means 32 are provided with controllable drive means 36, which can be controlled by means of a control unit or the like. In FIG. 6, these drive means 36 consist of a stepping motor with which the adjusting screw 33 is controlled. In FIG. 7, these drive means 36 consist of a pneumatic cylinder, whereby the above-mentioned adjusting screw 33 is then replaced by a sliding bar 37. Naturally, such drive means 36 can also be realized in other ways.

The drive means 36 can be controlled in different manners. They can for example be designed to set the position of the magnets 27 only once, every time a certain production is started, as a function of known parameters. This offers an enormous advantage in relation to the embodiment whereby adjusting screws to be manually set are used and whereby there is a disadvantage in that all these adjusting screws have to be set one after the other, which may often be more than 25 screws per press-on device 15 or 16.

The drive means 36 may also be designed to allow for a permanent adjusting of the press-on force, for example as a function of controls carried out either or not automatically on the end product.

Figure 8:
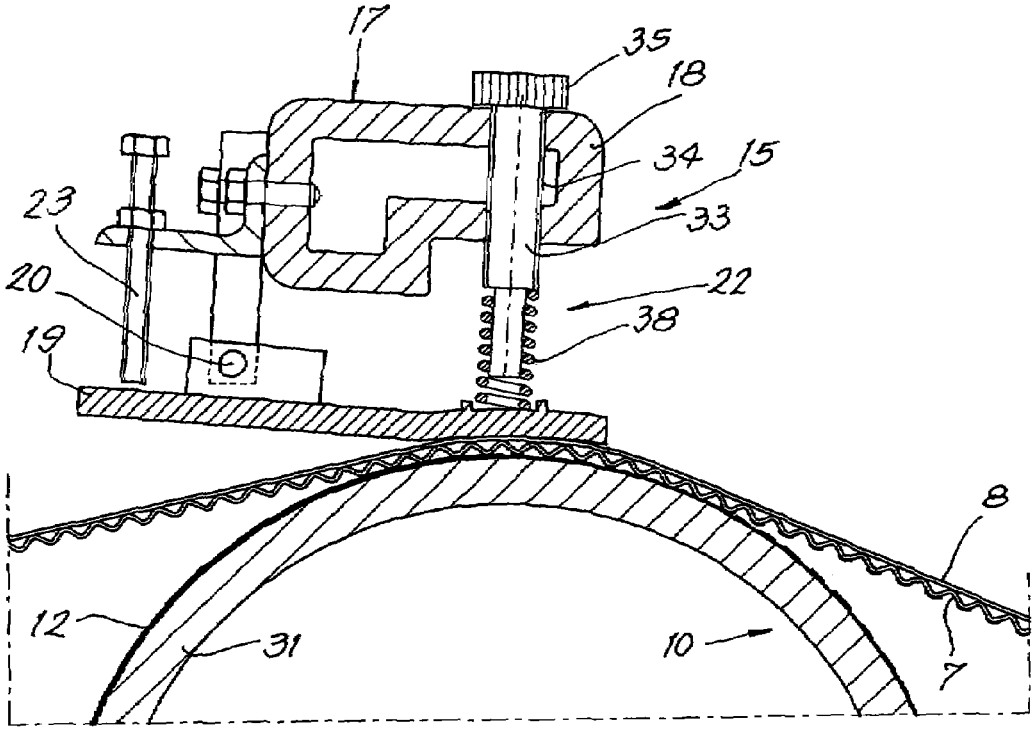
FIGS. 8 and 9 represent a variant for two different positions according to a view analogous to that in FIG. 3.
Figure 9:
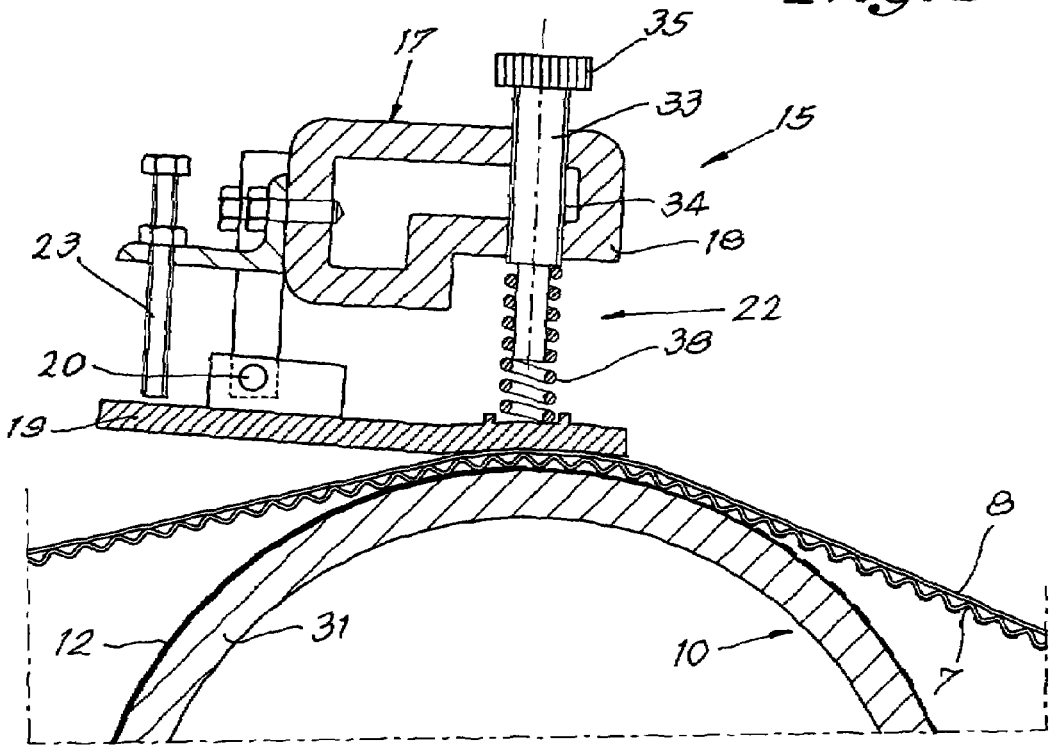

As mentioned in the introduction, the use of adjusting means 32 can also be useful in combination with other pressure means 22 than magnets, for example springs. An example thereof is given in FIGS. 8 and 9, whereby, by means of the position of the adjusting screws 33, the compression of such a spring 38 and thus the press-on force can be changed.

The invention is by no means limited to the above-described embodiments given as an example and represented in the accompanying drawings; on the contrary, such a method and device can be made in all sorts of variants while still remaining within the scope of the invention.

The invention claimed is:

1. A method for manufacturing corrugated board, wherein distinct material strips are fastened together by a bonding agent, comprising: guiding at least a corrugated material strip along at least one pressing device in which said corrugated material strip is guided over at least one support element and is pressed against said support element by a set of movable pressing parts, wherein for pressing on these pressing parts, use is made of magnetic forces, each of which are provided by an attraction or a repulsion between two permanent magnets situated directly opposite to each other, one of which is in contact with a respective one of the set of the movable pressing parts.

2. The method according to claim 1, wherein the magnetic forces provide the only pressing force for the pressing on step.

3. The method according to claim 1, wherein said steps of guiding and pressing are carried out at a location where bonding agent is applied against said corrugated material strip, and the support element comprises an element by which a bonding agent is provided against said corrugated material strip.

4. The method according to claim 1, wherein said steps of fastening, guiding and pressing are carried out at a location where two material strips are joined together, and wherein one of the strips has already been provided with a bonding agent.

5. The method according to claim 1, wherein the magnetic forces are at least also provided by a magnetic attraction between the support element and the pressing parts, through the corrugated material strip which is guided between the support element and the pressing parts.

6. The method according to claim 1, wherein use is made of adjusting means with which the magnetic forces, and thus also the pressing force, exerted on the pressing parts, can be either or both adjusted and set.

* * * * *